US007623079B2

(12) United States Patent
Hayashi

(10) Patent No.: US 7,623,079 B2
(45) Date of Patent: Nov. 24, 2009

(54) VEHICLE ANTENNA, MONITOR DISPLAY DEVICE HAVING VEHICLE ANTENNA, AN METHOD OF FORMING VEHICLE ANTENNA

(75) Inventor: Akihiko Hayashi, Oogaki (JP)

(73) Assignee: Denso Corporation, Kariya (JP)

( * ) Notice: Subject to any disclaimer, the term of this patent is extended or adjusted under 35 U.S.C. 154(b) by 729 days.

(21) Appl. No.: 11/167,297

(22) Filed: Jun. 28, 2005

(65) Prior Publication Data

US 2006/0001582 A1 Jan. 5, 2006

(30) Foreign Application Priority Data

Jun. 30, 2004 (JP) ..... 2004-193448

(51) Int. Cl.
*H01Q 1/32* (2006.01)
*H01Q 1/38* (2006.01)

(52) U.S. Cl. ..... 343/711; 343/700 MS

(58) Field of Classification Search ..... 343/711, 343/713, 700 MS, 846, 830, 793, 797, 810–820
See application file for complete search history.

(56) References Cited

U.S. PATENT DOCUMENTS 5,685,072 A * 11/1997 Wright ..... 29/866
7,142,980 B1 * 11/2006 Laverick et al. ..... 701/213
7,202,826 B2 * 4/2007 Grant et al. ..... 343/713
2004/0066342 A1 4/2004 Takaoka et al.

FOREIGN PATENT DOCUMENTS

JP 2004-129138 4/2004

* cited by examiner

*Primary Examiner*—Shih-Chao Chen
(74) *Attorney, Agent, or Firm*—Posz Law Group, PLC

(57) ABSTRACT

The vehicle antenna includes a frame made of conductive material and surrounding sides of a display section of a monitor display device mounted on a vehicle, and a radiation element attached to the frame. The frame serves as a ground plane of the vehicle antenna. The radiation element is situated in such a position that the radiation element is covered by a front panel escutcheon of the monitor display device.

15 Claims, 6 Drawing Sheets

VEHICLE ANTENNA, MONITOR DISPLAY DEVICE HAVING VEHICLE ANTENNA, AN METHOD OF FORMING VEHICLE ANTENNA

CROSS-REFERENCE TO RELATED APPLICATION

This application is related to Japanese Patent Application No. 2004-193448 filed on Jun. 30, 2004, the contents of which are hereby incorporated by reference.

BACKGROUND OF THE INVENTION

1. Field of the Invention

The present invention relates to a vehicle antenna for use, for example, in an in-vehicle wireless LAN, a monitor display device having the vehicle antenna, and a method of forming such a vehicle antenna.

2. Description of Related Art

It is known to mount an EMV (Electronic Multi-Vision display) having a vehicle antenna attached thereto in an instrument panel of a vehicle as a part of an in-vehicle Bluetooth communication system or an in-vehicle wireless LAN communication system, as described, for example, in Japanese Patent Application Laid-open No. 2004-129138.

The vehicle antenna described in this document is a plane antenna which is installed on the circuit board of the EMV. Accordingly, this vehicle antenna is located on the rear part of the EMV. However, in consideration of arrival directions of electromagnetic waves, it is desirable to locate the vehicle antenna on the front part of the EMV.

It may occur that the plane antenna is arranged on the front panel escutcheon of the EMV, or to the side of the LCD of the EMV, so that the plane antenna sits inside the vehicle cabin to obtain better antenna characteristics. However, in this case, there occurs a problem in that the beauty of appearance of the vehicle cabin is spoiled, because the plane antenna is exposed and viewed.

It may also occur that the plane antenna is covered by an appropriate member to avoid spoiling the beauty of appearance of the vehicle cabin. However, in this case there occurs a problem in that the production costs and installation costs increase because of the increase of the number of parts.

SUMMARY OF THE INVENTION

The vehicle antenna of the invention includes:

a frame made of conductive material and surrounding sides of a display section of a monitor display device mounted on a vehicle, the frame serving as a ground plane; and a radiation element attached to the frame, the radiation element being situated in such a position that the radiation element is covered by a front panel escutcheon of the monitor display device.

According to the invention, it becomes possible to mount a monitor display device provided with a vehicle antenna having an excellent antenna characteristic in an instrument panel of a vehicle without spoiling the beauty of appearance of the vehicle cabin. Furthermore, with this invention, the production costs and evaluation costs of vehicle antennas can be reduced, because the vehicle antenna of the invention can be standardized since the radiation element can be integrally formed with the frame surrounding the sides of the display section of the monitor display device during the process of forming this frame.

In addition, with this invention, vehicle antenna adjustment work after installation of the monitor display device becomes unnecessary at least for the same vehicle model, because the installation position of the vehicle antenna does not change for the same vehicle model.

The invention also provides the monitor display device including:

a display section having a frame made of conductive material and surrounding sides thereof; and a radiation element attached to the frame, the frame and the radiation element constituting a vehicle antenna, the frame serving as a ground plane of the vehicle antenna, the radiation element being situated in such a position that the radiation element is covered by a front panel escutcheon of the monitor display device.

The vehicle antenna can be formed by the method including the steps of:

cutting a flat plate made of conductive material to have a radiation element integral therewith, and bending the flat plate to a shape of a frame having the radiation element integral with the frame, the frame surrounding sides of a display section of a monitor display device mounted on a vehicle, the radiation element being situated in such a position that the radiation element is covered by a front panel escutcheon of the monitor display device.

PREFERRED EMBODIMENTS OF THE INVENTION

A monitor display device according to an embodiment of the invention used as an EMV in use for an in-vehicle Bluetooth communication system or an in-vehicle wireless LAN system is explained below. The term "EMV" includes a device having a capability of displaying various information such as map information supplied from a car navigation system, music information supplied from an audio instrument, air temperature information supplied from an air temperature sensor, and also a capability of accepting instructions from a user (driver or passengers) through a touch panel thereof.

Figure 1:
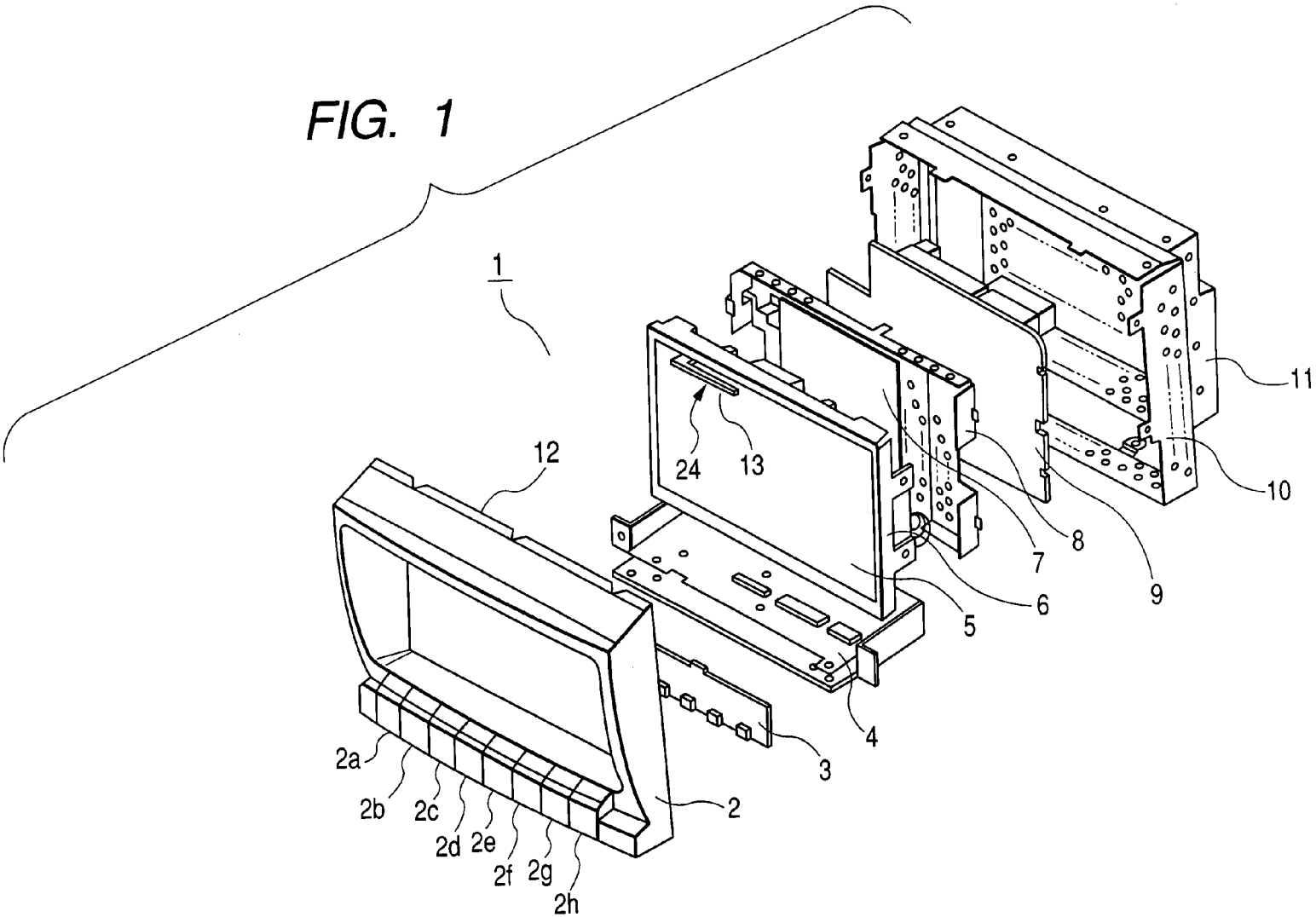
FIG. 1 is an exploded view of a monitor display device according to an embodiment of the invention.

FIG. 1 is an exploded diagram of an EMV 1. The parts constituting the EMV 1 includes a front panel escutcheon 2 serving as an operational panel, a switchboard 3, a first circuit board 4, an LCD 5 as a display section of the EMV 1, a metal frame 6, a second circuit board 7, a shielding case 8, a third circuit board 9, a frame 10, and a cover 11. The EMV 1 constituted by these parts is installed in an instrument panel (not shown) such that the front panel escutcheon 2 is exposed to the cabin side, and the cover 11 is situated in the front side of the vehicle.

The front panel escutcheon 2 has a row of operation buttons 2*a* to 2*h* in the lower part thereof, and a frame 12 having a rectangular opening allowing a user to view therethrough various information displayed on the screen of the LCD 5. The switch board 3, which is situated in the back of the lower part of the front panel escutcheon 2, includes electrical switch devices for detecting the user's manipulation of the operation buttons 2*a* to 2*h*. The first circuit board 4, on which various electronic devices are mounted, is situated below the LCD 5 such that surface thereof is perpendicular to the screen of the LCD 5.

The LCD 5, which is for displaying various information such as map information, music information, and air temperature information, has a touch panel formed on the screen thereof which allows the user to input various commands. The LCD 5 is fitted to the back of the metal frame 6. The second circuit board 7, on which various electronic devices are mounted, is situated in the back of the LCD 5. The shielding case 8 has a shape for containing the second circuit board 7 in a shielded state. The third circuit board 9, on which various electronic devices are mounted, is situated in the back of the shielding case 8. The frame 10 has a shape to cover the sides of the shielding case 8 and the third circuit board 9. The cover 11 covers the back of the third circuit board 9 when fitted to the frame 10.

Next, the metal frame 6 is explained in detail below.

The metal frame 6 is formed in a size fitting to the outside dimension of the LCD 5 (7-inch size, 8-inch size, 9-inch size, for example), and is shaped to be totally covered by the front panel escutcheon 2 when the front panel escutcheon 2 is fitted to the metal frame 6. Since the metal frame 6 is totally covered by the front panel escutcheon 2, the metal frame 6 is avoided from being viewed by the user and is protected from mechanical shocks.

Figure 2:
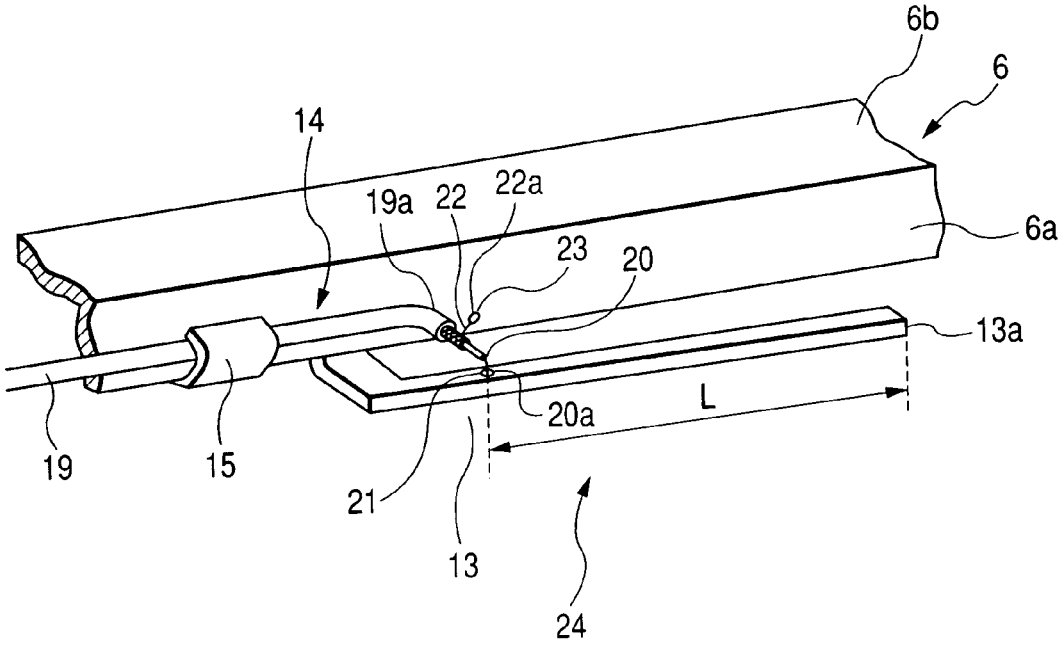
FIG. 2 is a partial perspective view of a metal frame of the monitor display device having a radiation element integrally formed therewith.
Figure 3:
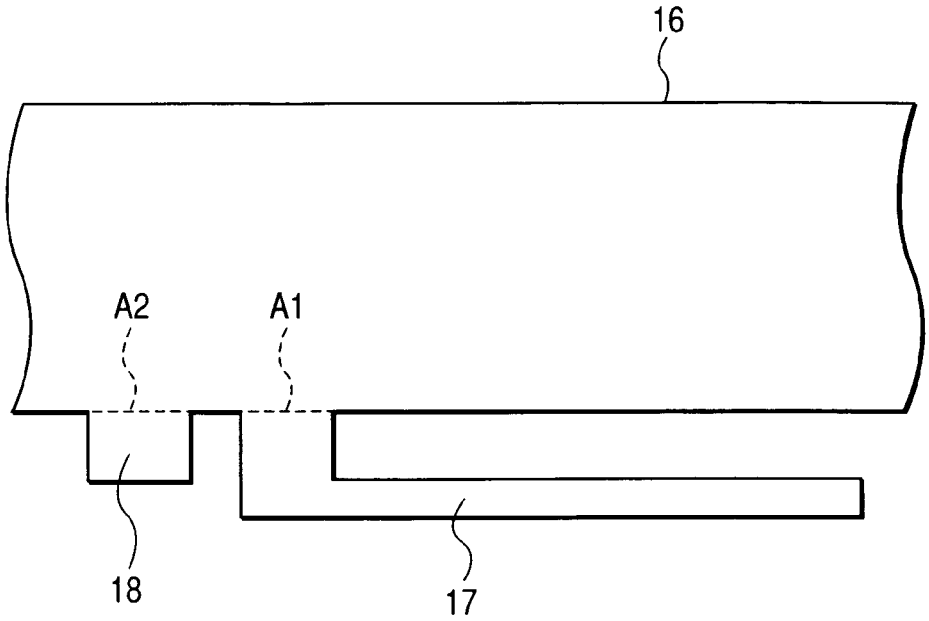
FIGS. 3 and 4 are diagrams explaining a process for forming the radiation element and a cable crimp member.

As shown FIG. 2, an inverted L-shaped radiation element 13 is formed integrally with the metal frame 6 at the front end 6*a* of the metal frame 6. A cable crimp member 15 is also formed integrally with the metal frame 6 at the front end 6*a* of the metal frame 6. The radiation element 13 and the cable crimp member 15 are formed in accordance with the below described process.

Figure 4:
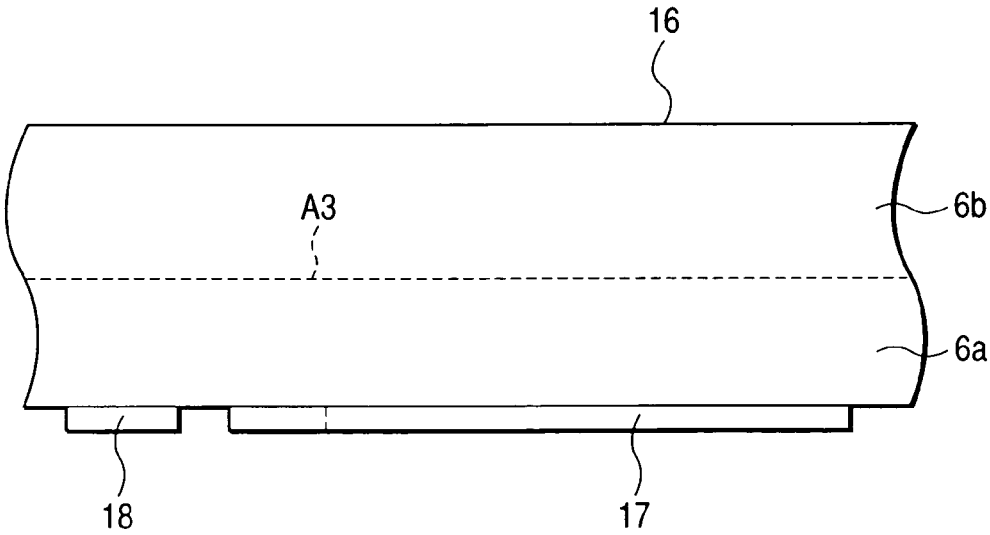

First, a conductive flat plate 16 is cut to have an inverted L-shaped portion 17 and a rectangular portion 18. The inverted L-shaped portion 17 is folded at about right angle along a broken line A1 to make the radiation element 13. The rectangular portion 18 is folded at about right angle along a broken line A2 to make the cable crimp member 15. As explained above, the metal frame 6, radiation element 13, and cable crimp member 15 can be formed at a time by press work. Next, the flat plate 16 is folded at about right angle along a broken line A3 shown in FIG. 4, to have the front end 6*a* and the upper end 6*b*.

After that, a coaxial cable 14 is placed such that the tip 19*a* of the sheath 19 of the cable 14 is situated on the cable crimp member 15 (see FIG. 2). In this state, the cable 14 is crimped by use of an appropriate crimp tool so that it is fixed to the metal frame 6. The center conductor 20 of the cable 14 is electrically connected to a predetermined portion of the radiation element 13 by a solder 21. The point at which the center conductor 20 and the radiation element 13 is connected with each other makes a feeding point. The length L between this point and the tip 13*a* of the radiation element 13 is set approximately equal to a quarter-wavelength of a radio signal to be received or transmitted (2.4 GHz band signal, for example).

Figure 5:
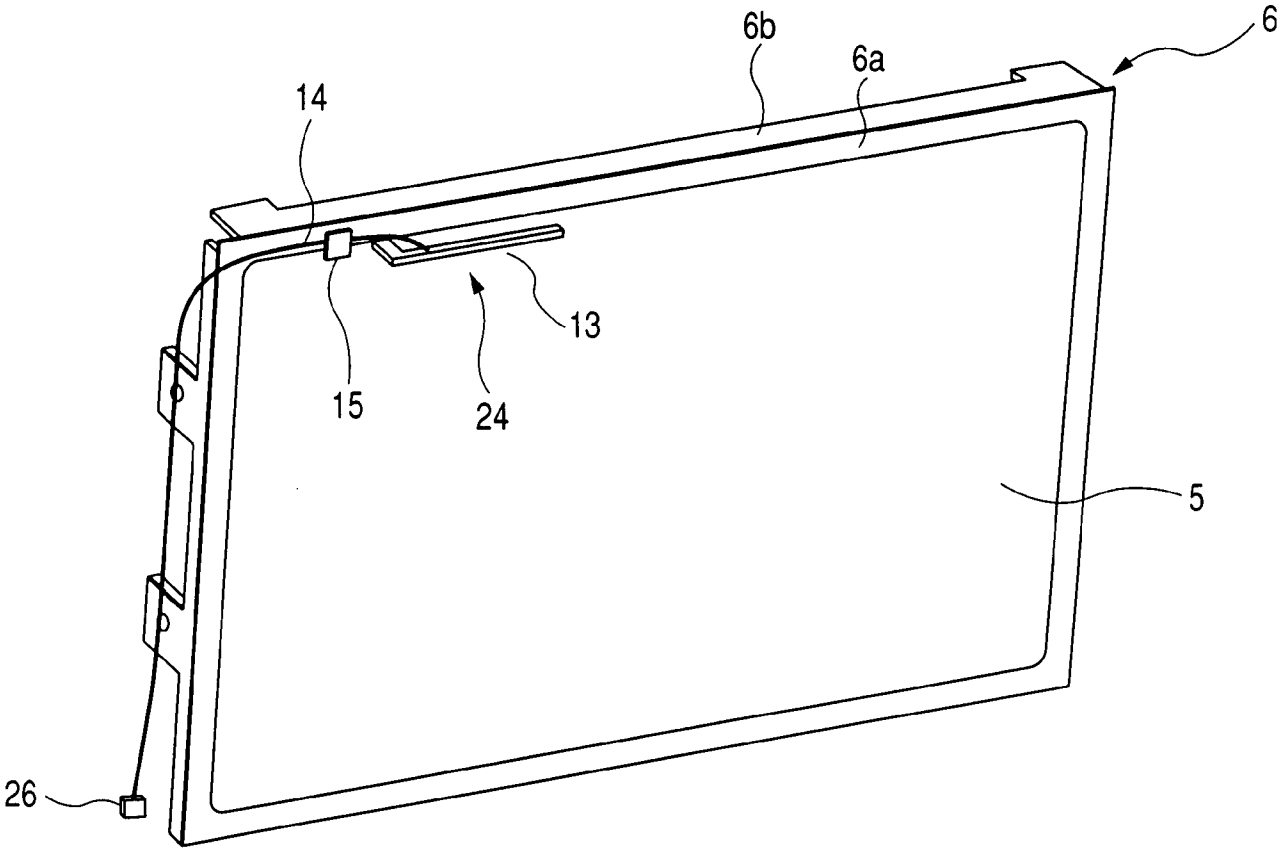
FIG. 5 is an external view of an LCD of the monitor display device.

The tip 22*a* of the outer conductor 22 of the coaxial cable 14 is electrically connected to a predetermined portion of the metal frame 6 by a solder 23. Thus, an inverted-F shaped antenna 24 constituted by the radiation element 13 and the metal frame 6 serving as a ground plane can be obtained as shown in FIG. 5. The sheath 19 of the coaxial cable 14, which leads to a connector 26 for connection with one of the circuit boards of the EMV, is fixed to the metal frame 6 by the cable crimp member 15 near the radiation element 13.

Incidentally, when a high frequency current flows through the radiation element 13, another high frequency current flows through the metal frame 6. Accordingly, the location of the radiation element 13 has to be such that these high frequency currents have the same phase. That is because, if these high frequency currents have the opposite phases, it becomes difficult to obtain an antenna gain high enough due to mutual cancellation of these high frequency currents.

Although this embodiment is described as using the inverted F-shaped antenna 24 for the in-vehicle Bluetooth communication system or in-vehicle wireless LAN system, this antenna can be used as an antenna for different systems such as a keyless entry system or a spot communication system. In this embodiment, it is possible to use a different antenna having two or more radiation elements formed integrally with the metal frame 6 for performing diversity reception.

Figure 8:
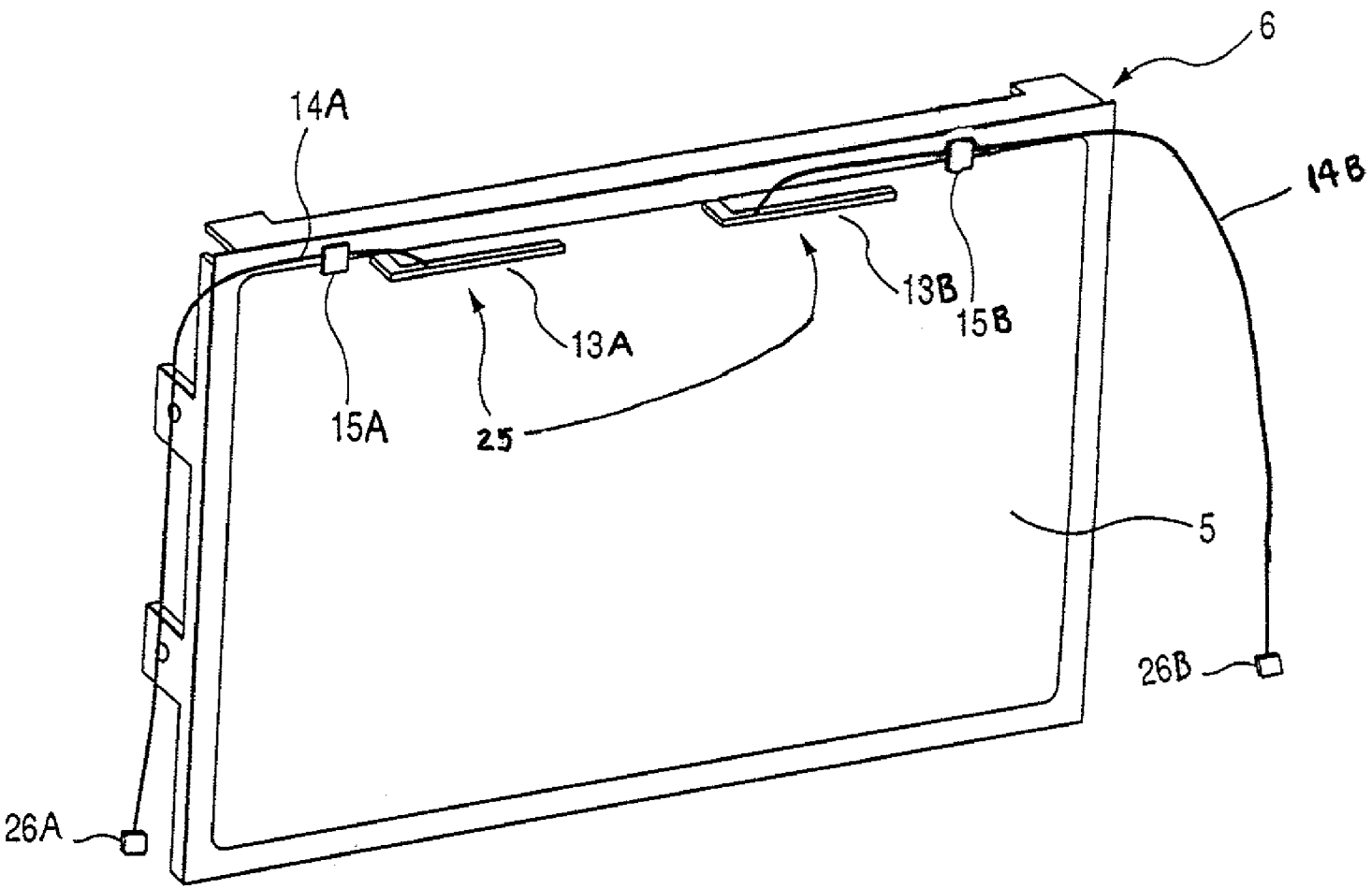
FIG. 8 is an external view of an LCD of a monitor display device having an antenna with two radiation elements.

FIG. 8 is an external view of an LCD of a monitor display device having an antenna with two radiation elements. This exemplary embodiment is similar to the embodiment of FIG. 5, except that it includes a dual F-shaped antenna 25, having two radiation elements 13A and 13B, two coaxial cables 14A and 14B, two cable crimp members 15A and 15B, and two connectors 26A and 26B.

Figure 6:
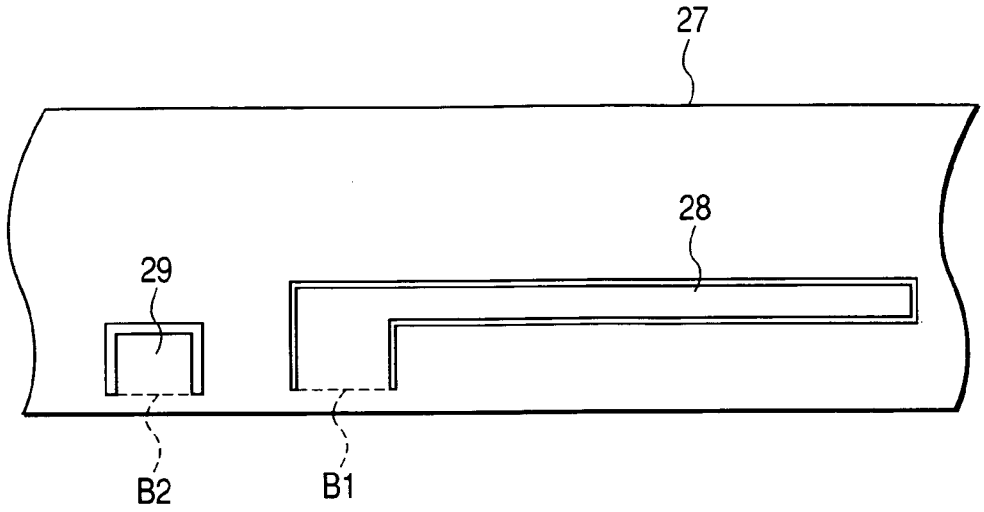
FIGS. 6 and 7 are diagrams explaining another process for forming the radiation element and the cable crimp member.
Figure 7:
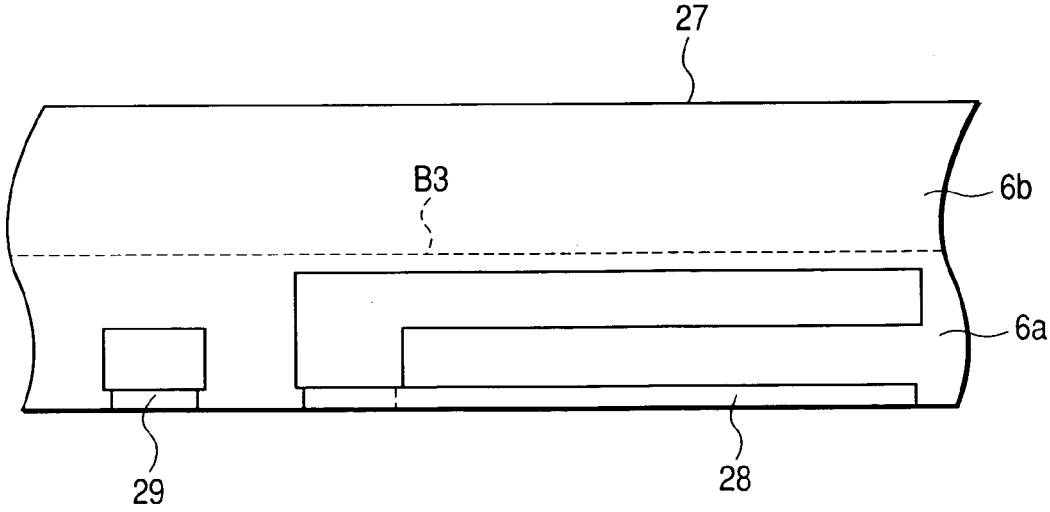

The radiation element 13 and the cable crimp member 15 can be formed integrally with the metal frame 6 by a process different from the above explained process, as explained below with reference to FIGS. 6 and 7. As shown in FIG. 6, a conductive flat plate 27 is cut to have an L-shaped perforation and an inverted U-shaped perforation. The L-shaped portion of the flat plate 27 defined by the L-shaped perforation is folded at about right angle along a broken line B1 to make the radiation element 13, and the rectangular portion of the flat panel 27 defined by the U-shaped perforation is folded at about right angle along a broken line B2 to make the cable crimp member 15 as shown in FIG. 7. After that, the flat plate 27 is folded at about right angle along a broken line B3 to make the front end 6*a* and the upper end 6*b* of the metal frame 6.

As explained above, in this embodiment, the inverted F-shaped antenna 24 is constituted by the inverted L-shaped radiation element 13 integrally formed with the metal frame 6 surrounding the sides of the LCD 5 by the front end 6*a* thereof which is covered by the front panel escutcheon 2, and the metal frame 6 serving as the ground plane. Accordingly, with this embodiment, it becomes possible to mount a monitor display device provided with an antenna having an excellent antenna characteristic in a vehicle without spoiling the beauty of appearance of the vehicle cabin.

Furthermore, with this embodiment, the production costs and evaluation costs of vehicle antennas can be reduced, because the inverted F-shaped antenna can be standardized since the radiation element 13 is integrally formed with the metal frame 6 during the process of forming the metal frame 6.

In addition, with this embodiment, vehicle antenna adjustment work after installation of the monitor display device becomes unnecessary at least for the same vehicle model, because the installation position of the inverted F-shaped antenna does not change for the same vehicle model.

Furthermore, since the coaxial cable 14 is fixed at the cable crimp member 15, the stress exerted on the connection point of the center conductor of the cable 14 to the radiation element 13, and the stress exerted on the connection point of the outer conductor of the cable 14 to the metal frame 6 are relatively small. Accordingly, the center and outer conductors are not disconnected from there connection points easily.

Although the above described embodiment is described as having the radiation element integrally formed with the metal frame, it is possible to form the radiation element separately from the metal frame, and weld this radiation element to the metal frame.

Although the radiation element is formed in the upper part of the front end of the metal frame in this embodiment, it may be formed in the lower part, or right part, or left part of the front end of the metal frame.

The above explained preferred embodiments are exemplary of the invention of the present application which is described solely by the claims appended below. It should be understood that modifications of the preferred embodiments may be made as would occur to one of skill in the art.

What is claimed is:

1. A vehicle antenna comprising:

a frame made of conductive material and surrounding sides of a display section of a monitor display device mounted on a vehicle, said frame serving as a ground plane; and a radiation element integral with said frame and extending from an inner edge surface of the frame, wherein said radiation element is situated in such a position that said radiation element is covered by a front panel escutcheon of said monitor display device.

2. The vehicle antenna according to claim 1, wherein said radiation element has an inverted-L shape, and said vehicle antenna is an inverted F-shaped antenna.

3. The vehicle antenna according to claim 1, wherein said frame and said radiation element are made of the same metal material.

4. The vehicle antenna according to claim 1, further comprising a cable crimp member integrally formed with said frame.

5. The vehicle antenna according to claim 1, wherein said display section includes a liquid crystal display.

6. A monitor display device comprising:

a display section having a frame made of conductive material and surrounding sides thereof; and a radiation element integral with said frame and extending from an inner edge surface of the frame, said frame and said radiation element constituting a vehicle antenna, said frame serving as a ground plane of said vehicle antenna said radiation element being situated in such a position that said radiation element is covered by a front panel escutcheon of said monitor display device.

7. The monitor display device according to claim 6, wherein said radiation element has an inverted-L shape, and said vehicle antenna is an inverted F-shaped antenna.

8. The monitor display device according to claim 6, wherein said frame and said radiation element are made of the same metal material.

9. The monitor display device according to claim 6, further comprising a cable crimp member integrally formed with said frame.

10. The monitor display device according to claim 6, wherein said display section includes a liquid crystal display.

11. The monitor display device according to claim 6, wherein said display section, said radiation element, said frame and said front panel escutcheon are arranged such that said front panel escutcheon is exposed to a cabin side of a vehicle on which said monitor display device is mounted.

12. The monitor display device according to claim 6, wherein said radiation element is electrically connected to a connector to which one of circuit boards of said monitor display device is electrically connected through a coaxial cable.

13. A method of forming a vehicle antenna comprising the steps of:

cutting a flat plate made of conductive material to have a radiation element integral therewith, and bending said flat plate to a shape of a frame having said radiation element integral with said frame, said frame surrounding sides of a display section of a monitor display device mounted on a vehicle, said radiation element being situated in such a position that said radiation element is covered by a front panel escutcheon of said monitor display device, and said radiation element extending from an inner edge surface of the frame.

14. The method according to claim 13, wherein said radiation element has an inverted-L shape, and said vehicle antenna is an inverted F-shaped antenna.

15. A monitor display device comprising:

a display section having a frame made of conductive material and surrounding sides thereof; and at least two radiation elements integral with said frame and extending from an inner edge surface of the frame, said frame and said radiation elements constituting vehicle antennas for performing diversity reception, said frame serving as a ground plane of said vehicle antennas, and said radiation elements being situated in such a position that said radiation elements are covered by a front panel escutcheon of said monitor display device.

* * * * *

UNITED STATES PATENT AND TRADEMARK OFFICE

CERTIFICATE OF CORRECTION

PATENT NO. : 7,623,079 B2
APPLICATION NO. : 11/167297
DATED : November 24, 2009
INVENTOR(S) : Akihiro Hayashi It is certified that error appears in the above-identified patent and that said Letters Patent is hereby corrected as shown below:

Title Page,

Item (54) and Col. 1, line 1 should read as follows:

(54) VEHICLE ANTENNA, MONITOR DISPLAY DEVICE HAVING VEHICLE ANTENNA, AND METHOD OF FORMING VEHICLE ANTENNA

Signed and Sealed this

Thirteenth Day of July, 2010

David J. Kappos

David J. Kappos
*Director of the United States Patent and Trademark Office*